US009877508B2

(12) United States Patent
Kane

(10) Patent No.: US 9,877,508 B2
(45) Date of Patent: Jan. 30, 2018

(54) ELECTRONIC CIGARETTE

(71) Applicant: Altria Client Services LLC, Richmond, VA (US)

(72) Inventor: David B. Kane, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 746 days.

(21) Appl. No.: 14/199,555

(22) Filed: Mar. 6, 2014

(65) Prior Publication Data

US 2014/0261490 A1 Sep. 18, 2014

Related U.S. Application Data

(60) Provisional application No. 61/799,499, filed on Mar. 15, 2013.

(51) Int. Cl.

| | |
|---|---|
| ***A24F 47/00*** | (2006.01) |
| ***A61M 15/06*** | (2006.01) |
| ***A24B 15/10*** | (2006.01) |
| ***A24B 15/16*** | (2006.01) |

(52) U.S. Cl.

CPC ..... *A24F 47/008* (2013.01); *A24B 15/10* (2013.01); *A24B 15/167* (2016.11)

(58) Field of Classification Search

CPC ..... A24F 47/00; A61M 15/06

See application file for complete search history.

(56) References Cited

U.S. PATENT DOCUMENTS

| | | | | | |
|---|---|---|---|---|---|
| 4,846,199 | A * | 7/1989 | Rose | A24B 15/165 131/198.2 |
| 4,969,476 | A * | 11/1990 | Bale | A24F 47/004 131/194 |
| 5,665,262 | A * | 9/1997 | Hajaligol | A24F 47/008 131/194 |
| 5,666,977 | A | 9/1997 | Higgins et al. | |
| 5,743,251 | A | 4/1998 | Howell et al. | |

(Continued)

FOREIGN PATENT DOCUMENTS

| | | | | |
|---|---|---|---|---|
| CN | WO 2010091593 A1 * | 8/2010 | ..... | A24F 47/008 |
| DE | 202013100606 U1 | 2/2013 | | |

(Continued)

OTHER PUBLICATIONS

Official Action dated Jun. 20, 2014 for Korean Appln. No. 10-2009-7027510.

(Continued)

*Primary Examiner* — Cynthia Szewczyk

(74) *Attorney, Agent, or Firm* — Harness, Dickey & Pierce

(57) ABSTRACT

A cartomizer for an electronic smoking article, an electronic smoking article capable of providing a smoking experience without combusting tobacco, and a method of achieving a smoking experience without combusting tobacco are disclosed. The cartomizer can include an annular fluid reservoir having an air flow channel therein; a liquid material within the fluid reservoir; and a heater, which surrounds the fluid reservoir and is operable to heat the fluid reservoir to a temperature sufficient to at least initially volatilize the liquid material contained within the fluid reservoir to form a saturated vapor within the air flow channel.

16 Claims, 2 Drawing Sheets

(56) References Cited

U.S. PATENT DOCUMENTS

| | | | | |
|---|---|---|---|---|
| 2008/0230052 | A1* | 9/2008 | Montaser | A61M 15/0085 128/200.16 |
| 2008/0276947 | A1* | 11/2008 | Martzel | A24F 47/008 131/273 |
| 2009/0095287 | A1* | 4/2009 | Emarlou | A61M 11/041 128/200.14 |
| 2011/0011396 | A1* | 1/2011 | Fang | A24F 47/008 128/202.21 |
| 2011/0277757 | A1* | 11/2011 | Terry | A24F 47/008 128/202.21 |
| 2012/0111347 | A1* | 5/2012 | Hon | A24F 47/008 131/329 |
| 2012/0260927 | A1 | 10/2012 | Liu | |
| 2013/0037041 | A1* | 2/2013 | Worm | A24F 47/008 131/329 |

FOREIGN PATENT DOCUMENTS

| | | | |
|---|---|---|---|
| EP | 2113178 | A1 | 11/2009 |
| JP | 2005-512555 | A | 5/2005 |
| WO | 2007078273 | A1 | 7/2007 |

OTHER PUBLICATIONS

International Search Report and Written Opinion dated Jul. 16, 2014 for PCT/US2014/022648.

Office Action for corresponding Chinese Application No. 201480016003.2 dated Apr. 27, 2017 and English translation thereof.

Office Action for corresponding Russian App. No. 2015144290 dated Oct. 2, 2017 and English translation thereof.

* cited by examiner

ELECTRONIC CIGARETTE

RELATED APPLICATION(S)

The present application claims priority under 35 U.S.C. 119 to U.S. Provisional Patent Application No. 61/799,499, filed on Mar. 15, 2013, the entire content of which is hereby incorporated by reference.

WORKING ENVIRONMENT

Electronic smoking articles, such as electronic cigarettes and cigars can include heated capillary aerosol generators and manually operative arrangements to deliver liquid from a liquid supply source to the capillary while the capillary is being heated. The heated capillary volatilizes a liquid such as by way of the teachings set forth in U.S. Pat. No. 5,743,251, which is incorporated herein in its entirety by reference thereto. A cartomizer combines the aerosol generator and the liquid supply in a single disposable cartridge.

SUMMARY

In accordance with an exemplary embodiment, a cartomizer for an electronic smoking article is disclosed, the cartomizer comprising: an annular fluid reservoir having an air flow channel therein; a liquid material within the fluid reservoir; and a heater, which surrounds the fluid reservoir and is operable to heat the fluid reservoir to a temperature sufficient to at least initially volatilize the liquid material contained within the fluid reservoir to form a saturated vapor within the air flow channel.

In accordance with an exemplary embodiment, an electronic smoking article capable of providing a smoking experience without combusting tobacco is disclosed, the electronic smoking article comprising: a power supply; a cartomizer, which includes: a fluid reservoir having an air flow channel therein; a liquid material within the fluid reservoir; and a heater, which surrounds the fluid reservoir and is operable to heat the fluid reservoir to a temperature sufficient to at least initially volatilize the liquid material contained within the fluid reservoir to form a saturated vapor within the air flow channel; and a condensation chamber on a downstream end of the cartomizer, and wherein air passing through the air flow channel is saturated with components of a flavor solution within the liquid material and condenses to form a smoke-like aerosol as the air and volatilized liquid material exit the air flow channel into the condensation chamber.

In accordance with an exemplary embodiment, a method of achieving a cigarette experience without combusting tobacco is disclosed, the method comprising: heating a liquid material within a fluid reservoir with a heater, which surrounds the fluid reservoir and is operable to heat the fluid reservoir to a temperature sufficient to at least initially volatilize the liquid material contained within the fluid reservoir; combining the at least initially volatilized liquid material with an air flow within an air flow channel, which is surrounded by the fluid reservoir to form a saturated vapor; and condensing the saturated vapor within a condensation chamber in communication with air flow channel to form an aerosol.

In accordance with an exemplary embodiment, the electronic smoking article can also include a mouth-end insert in fluid communication with the condensation chamber so as to deliver an aerosol to a smoker.

BRIEF DESCRIPTION OF THE DRAWINGS

The disclosure is explained below with reference to the exemplary embodiments shown in the drawings. In the drawings.

DETAILED DESCRIPTION

Figure 1:
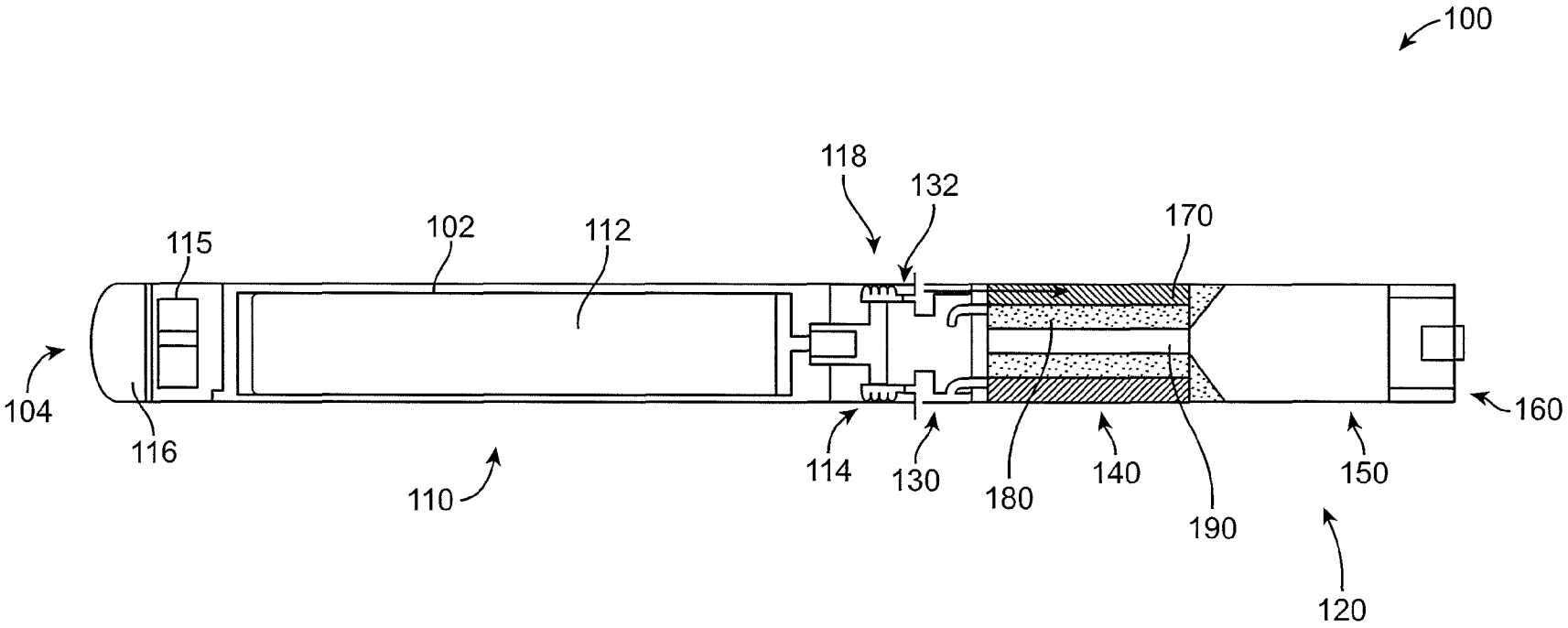
FIG. 1 is a cross-sectional view of an electronic cigarette according to an exemplary embodiment.

FIG. 1 is a cross-sectional view of an electronic smoking article 100, such as an electronic cigarette according to an exemplary embodiment. As shown in FIG. 1, an electronic smoking article 100 comprises a reusable fixture (or first section) 110, and a replaceable cartomizer section (or second cartomizer section) 120, which are coupled together at a threaded joint (not shown) or by other convenience such as a snug-fit, snap-fit, detent, clamp and/or clasp.

In accordance with an exemplary embodiment, the first section 110 can house a power supply 112 preferably a battery and control circuitry 115. The threaded portion 118 of the first section 110 can be connected to a battery charger when not connected to the first section 110 for use so as to charge the battery. In accordance with an exemplary embodiment, the replaceable cartomizer section 120 can include a connector portion 130, a cartomizer 140, a condensation chamber 150, and a mouth-end insert 160.

Figure 2:
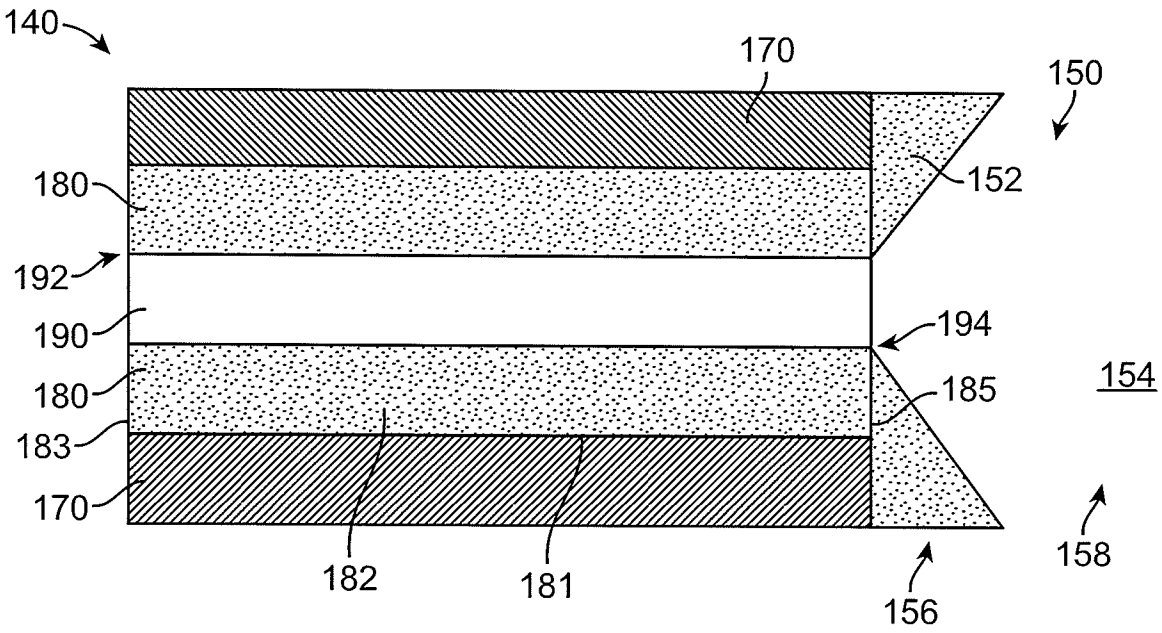
FIG. 2 is a cross-sectional view of the cartomizer in accordance with an exemplary embodiment.

In accordance with an exemplary embodiment, the cartomizer 140 as shown in FIG. 2 includes a fluid reservoir 180 having an air flow channel therein 190 and a heater 170, which surrounds the fluid reservoir 180 and is operable to heat the fluid reservoir 180 to a temperature sufficient to at least initially volatilize liquid material 182 contained within the fluid reservoir 180 and forming a saturated vapor within the air flow channel 190.

Preferably, the reusable fixture 110 and the cartomizer section 120 have a generally cylindrical outer housing 102 extending in a longitudinal direction along the length of the electronic smoking article 100. In accordance with an exemplary embodiment, the electronic smoking article 100 is formed so that the diameter of the electronic cigarette is preferably substantially uniform along the length thereof. In accordance with an exemplary embodiment, the outer cylindrical housing 102 may be substantially continuous along the length thereof and can be rigid.

In accordance with an exemplary embodiment, a pressure activated switch (not shown) can be positioned on an outer surface of the outer cylindrical housing 102, which acts to activate the heater. By applying manual pressure to the pressure switch, the power supply is activated and an electric current heats the liquid material 182 in the cartomizer 140 via electrical contacts so as to volatilize the liquid material 182. For example, a depression (not shown) can be formed in the outer cylindrical housing 102 to indicate where the smoker should apply pressure. The depression can extend fully or partially about the circumference of the outer cylindrical housing 102.

FIG. 2 is a cross-sectional view of the cartomizer 140 in accordance with an exemplary embodiment. As shown in FIG. 2, the cartomizer 140 can be a tubular, elongate body formed of a semi-rigid and/or rigid material. The cartomizer 140 includes a fluid reservoir 180 having an air flow channel 190 therein. A heater 170 is configured to surround the fluid reservoir 180 and is operable to heat the fluid reservoir 180 to a temperature sufficient to at least initially volatilize liquid material 182 contained within the fluid reservoir 180 to form a saturated vapor within the air flow channel 190. The heater 170 can be a tubular, elongate member configured to surround the liquid reservoir 180. The air flow channel 190 has an inlet or proximal end 192 and an outlet or distal end 194.

In accordance with an exemplary embodiment, the fluid reservoir 180 can be a fibrous or porous material, which holds the liquid material 182 within interstices or a plurality of pores within the porous material. In accordance with an exemplary embodiment, the fluid reservoir 180 can be formed from a fibrous material, which holds the liquid material 182 within the fluid reservoir 180. The fluid reservoir 180 preferably has an annular geometry in the form of a tubular, elongate member, which is surrounded by the heater 170. In accordance with an exemplary embodiment, the fluid reservoir 180 has an outer wall 181 between the heater 190 and the liquid material 182. In addition, the fluid reservoir 180 can include a pair of end walls 183, 185. In accordance with an exemplary embodiment, the fluid reservoir 180 can be constructed from a conductive or semi-conductive material and can be used as a heating element or heater, rather than requiring a separate heater 170 as shown.

In accordance with an exemplary embodiment, wherein air passes through the air flow channel 190, the air is saturated with components of a flavor solution within the liquid material 182 and condenses to form a smoke-like aerosol as the air and volatilized liquid material exits the outlet 194 of the air flow channel 190 into the condensation chamber 150. The air flow channel 190 can be an annular member having an inlet 192 in communication with one or more air inlets or vent holes 132 (FIG. 1) and an outlet 194 in communication with a condensation chamber 150. In accordance with an exemplary embodiment, upon drawing on the mouth-end insert 160, the volatized liquid material 182 is drawn from the air flow channel 190 into the condensation chamber 150.

In accordance with an exemplary embodiment, the cartomizer 140 can have a length of about 1.0 to 3.0 cm with a diameter of about 7 to 8 mm. The annular reservoir 180 can have an outer diameter of about 6 to 7 mm and an inner diameter of about 1 to 6 mm. The air flow channel 190 can have a diameter of about 1 to 5 mm. In accordance with an exemplary embodiment, the fluid reservoir holds about 0.25 to 1.0 cc of liquid material 182, and more preferably about 0.5 cc of liquid material 182. In accordance with an exemplary embodiment, a layer of insulation (not shown) can be placed between the heater 170 and outer wall or housing 102 of the smoking article 100.

The condensation chamber 150 is preferably adjacent to the outlet or distal end 194 of the air flow channel 190. The condensation chamber 150 preferably has a conical member 152, which extends outward from the distal end 194 of the air flow channel into an annular cavity 154.

In accordance with an exemplary embodiment, the condensation chamber 150 can have one or more air inlets (not shown), and wherein between about 0% to 50% of the air passing through the condensation chamber 150 is provided by the one or more inlets. In accordance with an exemplary embodiment, the air inlets can provide additional cooling to the saturated vapor from the air flow channel 150 and assist with aerosol formation. In accordance with an exemplary embodiment, the air flow from the one or more inlets can be directed toward the air flow channel 190, parallel to the air flow channel 190, or into the condensation chamber 150 at any desired angle.

In accordance with an exemplary embodiment, the power supply 112 is activated upon application of manual pressure to the pressure switch and the cartomizer 140 is heated to form a heated section wherein the liquid material 182 within the fluid reservoir is volatilized. Upon discharge from the air flow channel 190, the volatilized material expands, mixes with air and forms an aerosol.

In use, the fluid reservoir 180 is heated, the liquid material 182 contained within the fluid reservoir 180 is volatilized and ejected out of an outer or distal end 194 of the air flow channel as a saturated vapor where it expands and mixes with the air from the air flow channel and forms an aerosol in a condensation chamber 150. The condensation chamber 150 preferably has a conical proximal portion 156, which expands outward to an annular distal portion 158.

Preferably, the electronic smoking article 100 also includes at least one air inlet (or vent hole) 132 operable to deliver air to the air flow channel 190. Preferably, the air inlets 132 are arranged upstream of the cartomizer 140. In use, the volatilized material expands out of the outlet or distal end 194 of the air flow channel 190 into the condensation chamber 150 where the saturated vapor forms an aerosol, which is then drawn through the mouth-end insert 160. The mouth-end insert 160 is preferably configured to fit inside an outer tubular shell of the smoking article 100 and is not exposed except at end face with diverging outlets. In the preferred embodiment, the at least one air inlet 132 includes one or two air inlets. Alternatively, there may be three, four, five or more air inlets. Altering the size and number of air inlets 132 can also aid in establishing the resistance to draw of the electronic smoking article 100.

In an exemplary embodiment, the power supply 112 includes a battery arranged in the electronic smoking article 100 such that the anode is downstream of the cathode. A battery anode connector contacts the downstream end of the battery. The heater 170 can be connected to the battery by two spaced apart electrical leads or contacts (not shown). The power supply 112 is operable to apply voltage across the heater 170 associated with the cartomizer 140 and volatilizes liquid material 182 contained therein according to a power cycle of either a predetermined time period, such as a 5 second period, or for so long as the pressure activated switch.

Preferably, the electrical contacts or connection between the heater 170 and the electrical contacts (not shown) are highly conductive and temperature resistant so that heat generation occurs primarily along the heater 170 and not at the contacts.

The power supply 112 can be a Lithium-ion battery or one of its variants, for example a Lithium-ion polymer battery. Alternatively, the power supply 112 may be a Nickel-metal hydride battery, a Nickel cadmium battery, a Lithium-manganese battery, a Lithium-cobalt battery or a fuel cell. In that case, preferably, the electronic smoking article 100 is usable by a smoker until the energy in the power supply is depleted. Alternatively, the power supply 112 may be rechargeable and include circuitry allowing the battery to be chargeable by an external charging device. In that case, preferably the circuitry, when charged, provides power for a pre-determined number of puffs, after which the circuitry must be re-connected to an external charging device.

Preferably, the electronic smoking article 100 also includes control circuitry 115, which can be on a printed circuit board (not shown). Once the pressure switch is pressed, the power supply is activated and supplies power to the heater 170. The control circuitry 115 can also include a heater activation light 116 operable to glow when the heater 170 is activated. Preferably, the heater activation light 116 comprises an LED and is at an upstream end 104 of the electronic smoking article 100 so that the heater activation light 116 takes on the appearance of a burning coal during a puff. Moreover, the heater activation light 116 can be arranged to be visible to the smoker. In addition, the heater activation light 116 can be utilized for cigarette system diagnostics. The light 116 can also be configured such that the smoker can activate and/or deactivate the light 116 when desired, such that the light 116 would not activate during smoking if desired.

The control circuitry 115 is electrically connected to the pressure switch (not shown) and supplies power to the heater 170 responsive to pressing the pressure switch, preferably with a maximum, time-period limiter (e.g. a timing circuit). The control circuitry 115 can also include a timer operable to limit the time for which power is supplied to the heater 170.

The time-period of the electric current supply to the heater 170 may be pre-set depending on the amount of liquid desired to be vaporized. The control circuitry 115 can be programmable for this purpose. The control circuitry can be an application specific integrated circuit (ASIC).

In the preferred embodiment, the liquid reservoir 180 includes a liquid material 182 which has a boiling point suitable for use in the electronic smoking article 100. If the boiling point is too high, the heater 170 will not be able to vaporize the liquid material in the fluid reservoir 180. However, if the boiling point is too low, the liquid material 182 may vaporize without the heater 170 being activated. In accordance with an exemplary embodiment, the vaporization of the liquid material 182 can be controlled by the temperature of the heater 170. In accordance with an exemplary embodiment, the temperature of the heater 170 can be controlled through the power supply 112.

Preferably, the liquid material 182 includes a tobacco-containing material including volatile tobacco flavor compounds which are released from the liquid material 182 upon heating. The liquid material 182 may also be a tobacco flavor containing material and/or a nicotine-containing material. Alternatively, or in addition, the liquid material 182 may include a non-tobacco material and/or may be nicotine-free. For example, the liquid material 182 may include water, solvents, ethanol, plant extracts and natural or artificial flavors. Preferably, the liquid material further includes an aerosol former. Examples of suitable aerosol formers are glycerine and propylene glycol.

The electronic smoking article 100 further includes a mouth-end insert 160, which is in fluid communication with the condensation chamber 150 and includes at least two diverging outlets (not shown), for example 3, 4, 5, or preferably 6 to 10 outlets or more. Preferably, four outlets of the mouth-end insert 160 are located at ends of off-axis passages and are angled outwardly in relation to the longitudinal direction of the electronic smoking article 100 (i.e., divergently). As used herein, the term "off-axis" denotes at an angle to the longitudinal direction of the electronic cigarette. Also preferably, the mouth-end insert 160 includes outlets uniformly distributed around the mouth-end insert 160 so as to substantially uniformly distribute aerosol in a smoker's mouth during use. Thus, as the aerosol passes into a smoker's mouth, the aerosol enters the mouth and moves in different directions so as to provide a full mouth feel as compared to electronic cigarettes having an on-axis single orifice, which directs the aerosol to a single location in a smoker's mouth.

In an exemplary embodiment, the electronic smoking article 100 is about the same size as a conventional cigarette. In some embodiments, the electronic cigarette 60 can be about 80 mm to about 110 mm long, preferably about 80 mm to about 100 mm long and about 7 mm to about 8 mm in diameter. For example, in an exemplary embodiment, the electronic cigarette is about 84 mm long and has a diameter of about 7.8 mm.

The outer cylindrical housing 102 of the electronic smoking article 100 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, low density polyethylene (LDPE) and high density polyethylene (HDPE). Preferably, the material is light and non-brittle. Thus, the outer cylindrical housing 102 can be formed of a variety of materials including plastics, rubber and combinations thereof. In a preferred embodiment, the outer cylindrical housing 102 is formed of silicone. The outer cylindrical housing 102 can be any suitable color and/or can include graphics or other indicia printed thereon.

The heater 170 preferably includes an electrical heating element. The heater 170 preferably includes an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may include doped or undoped ceramics.

Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminum-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminum based alloys. Timetal® is a registered trademark of Titanium Metals Corporation, 1999 Broadway Suite 4300, Denver, Colo. In composite materials, the electrically resistive material may optionally be embedded in, encapsulated or coated with an insulating material or vice-versa, depending on the kinetics of energy transfer and the external physicochemical properties required.

In accordance with an exemplary embodiment, the fluid reservoir 180 can be made from a variety of porous or capillary materials and preferably has a known, pre-defined capillarity. Examples include ceramic- or graphite-based materials in the form of fibers or sintered powders. The fluid reservoir 180 can have different porosities, which can be used to accommodate different liquid physical properties such as density, viscosity, surface tension and vapor pressure.

In an exemplary embodiment, the volatilized liquid material 182 formed as described herein can at least partially condense to form an aerosol including particles. Preferably, the particles contained in the vapor and/or aerosol range in size from about 0.5 micron to about 4 microns, preferably about 1 micron to about 4 microns. Also preferably, the particles are substantially uniform throughout the vapor and/or aerosol.

In accordance with an exemplary embodiment, at a temperature of approximately 130° C. a delivery of about 4.5 mg total and about 0.08 mg nicotine can be achieved from about 4% nicotine in about 60% propylene glycol/40% glycerin solution. In accordance with an exemplary embodiment, higher flavor deliveries can be achieved by increasing the levels of the flavor components in the carrier solution. For example, Table 1 shows predicted delivery of an aerosol produced by the cartomizer as shown in FIGS. 1 and 2 in accordance with an exemplary embodiment.

TABLE 1

| Temperature (° C.) | Total delivery (mg) | Nicotine delivery (mg) |
|---|---|---|
| 100 | 1.2 | 0.02 |
| 110 | 1.9 | 0.04 |
| 120 | 3.0 | 0.06 |
| 130 | 4.5 | 0.08 |
| 140 | 6.7 | 0.12 |
| 150 | 9.7 | 0.17 |
| 160 | 13.7 | 0.23 |
| 170 | 19.0 | 0.32 |
| 180 | 26.1 | 0.42 |
| 190 | 35.2 | 0.55 |
| 200 | 46.8 | 0.71 |

Table 1 shows predicted delivery of an aerosol with a 55 ml puff (with 45% of the puff volume passing through the air flow channel 190) produced by the cartomizer system described here, with a flavor solution consisting of 4% nicotine in a solution of 40% glycerin and 60% propylene glycol. Note this calculation assumes 100% saturation of the vapor, which is an upper limit on the delivery.

The teachings herein are applicable to electronic cigars, and references to "electronic smoking article(s)" is intended to be inclusive of electronic cigars, electronic cigarettes and the like.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, for example, weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features, which meet the strict definitions but also features, which fairly approximate the strict definitions.

It will now be apparent that a new, improved, and non-obvious electronic cigarette has been described in this specification with sufficient particularity as to be understood by one of ordinary skill in the art. Moreover, it will be apparent to those skilled in the art that numerous modifications, variations, substitutions, and equivalents exist for features of the electronic cigarette, which do not materially depart from the spirit and scope of the invention. Accordingly, it is expressly intended that all such modifications, variations, substitutions, and equivalents, which fall within the spirit and scope of the invention as defined by the appended claims, shall be embraced by the appended claims.

What is claimed is:

1. A cartridge for an electronic vaping article, the cartridge comprising:

an outer housing;

an annular reservoir in the outer housing, the annular-reservoir including, an outer wall, a first end wall at a first end of the annular reservoir, a second end wall at a second end of the annular reservoir, and an air flow channel defined by the reservoir, the air flow channel extending through a central portion of the annular reservoir;

a liquid material held between the outer wall, the first end wall, and the second end wall of the reservoir; and a heater surrounding the reservoir, such that the outer wall is between the liquid material and the heater, the heater configured to heat the reservoir to a temperature sufficient to at least initially volatilize the liquid material contained within the reservoir and form a saturated vapor within the air flow channel, the heater between the outer housing and the outer wall of the annular reservoir.

2. The cartridge of claim 1, wherein the reservoir comprises:

a porous material including a plurality of pores, the porous material configured to hold the liquid material within the plurality of pores, the porous material being housed in a space defined by the outer wall, the first end wall, and the second end wall.

3. The cartridge of claim 1, wherein the reservoir includes a fibrous material, which holds the liquid material within the reservoir, and which is housed within the outer wall, the first end wall, and the second end wall.

4. The cartridge of claim 1, further comprising:

a condensation chamber between the air flow channel and a mouth-end insert.

5. The cartridge of claim 1, further comprising;

a condensation chamber adjacent a distal end of the air flow channel.

6. The cartridge of claim 5, wherein the condensation chamber has a conical member, which extends outward from the distal end of the air flow channel into an annular cavity.

7. The cartridge of claim 1, wherein the air flow channel is defined by a tubular member having an inlet in communication with one or more air inlets and an outlet in communication with a condensation chamber.

8. The cartridge of claim 1, wherein the heater is a tubular, elongate member.

9. An electronic vaping article comprising:

a power supply section including, a first outer housing, and a power supply in the first outer housing; and a cartridge including, a second outer housing;

a reservoir in the second outer housing, the reservoir including, an outer wall, a first end wall at a first end of the reservoir, a second end wall at a second end of the reservoir, and an air flow channel extending through the reservoir;

a liquid material held between the outer wall, the first end wall, and the second end wall of the reservoir; and a heater surrounding the reservoir, such that the outer wall is between the liquid material and the heater, the heater-configured to heat the reservoir to a temperature sufficient to at least initially volatilize the liquid material contained within the reservoir to form a saturated vapor within the air flow channel, the heater between the second outer housing and the outer wall of the reservoir; and a condensation chamber downstream of the cartridge.

10. The electrical vaping article of claim 9, further comprising:

a mouth-end insert in fluid communication with the condensation chamber.

11. The electrical vaping article of claim 9, wherein the first outer housing and the second outer housing are cylindrical housings extending in a longitudinal direction, the first outer housing containing electrical circuitry.

12. The electronic vaping article of claim 9, wherein the power supply includes a battery and the heater is connected to the battery by electrical contacts.

13. The electronic vaping article of claim 9, wherein the power supply is configured to apply voltage to the heater.

14. The electronic vaping article of claim 9, further comprising:

control circuitry configured to control supply of power from the power supply to the heater, the control circuitry including a heater activation light.

15. The electronic vaping article of claim 9, wherein the cartridge is replaceable.

16. The electronic vaping article of claim 9, further comprising:

at least one air inlet configured to deliver air to the air flow channel.

* * * * *